United States Patent [19]

Tonkel

[11] Patent Number: 4,805,319

[45] **Date of Patent: * Feb. 21, 1989**

[54] CUSHIONING AND IMPACT ABSORPTIVE MEANS FOR FOOTWEAR OPERATIVE COMPONENT

[75] Inventor: Raymond F. Tonkel, St. Louis, Mo.

[73] Assignee: Kangaroos U.S.A., Inc., St. Louis, Mo.

[ * ] Notice: The portion of the term of this patent subsequent to Apr. 14, 2004 has been disclaimed.

[21] Appl. No.: 17,085

[22] Filed: Feb. 19, 1987

Related U.S. Application Data

[63] Continuation-in-part of Ser. No. 705,659, Feb. 26, 1985, Pat. No. 4,656,760.

[51] Int. Cl.[4] ..... A43B 13/18

[52] U.S. Cl. ..... 36/28; 36/30 R; 36/35 R

[58] Field of Search ..... 36/25 R, 27, 28, 29, 36/30 R; 30 A, 37, 44, 43, 114

[56] References Cited

U.S. PATENT DOCUMENTS

| | | | |
|---|---|---|---|
| 1,923,169 | 8/1933 | Simmons | 36/44 |
| 2,237,190 | 4/1941 | McLead | 36/29 |
| 2,677,906 | 5/1954 | Reed | 36/28 X |
| 4,031,579 | 6/1977 | Larned | 297/453 X |
| 4,561,195 | 12/1985 | Onoda et al. | 36/28 X |
| 4,656,760 | 4/1987 | Tonkel et al. | 36/28 |

*Primary Examiner*—Stuart S. Levy

*Assistant Examiner*—Thomas R. Hannon

*Attorney, Agent, or Firm*—Paul M. Denk

[57] ABSTRACT

This invention pertains to the encapsulation of a cellular insert, formed of various woven cellular components, or fabricated to a grooved design formed of a series of linearly woven strands, each of which presents various voids or cavities within their formed structure, and then foamed in place within a polymer formed sock liner or insole for use within footwear, and particularly an athletic shoe, including the sole of a walking or other shoe. The cellular insert may be formed of a series of woven or wound cellular shaped components, having their voids therein, and which may be arranged intermediate a pair of liners, which form the upper and lower liners for the formed insert, or arranged upon a singular liner, or having the liner woven through its midpoint, in order to provide for its rather proper location within the structure of the polymer formed sole or insole. In addition, the cellular insert, as previously explained, may be formed of a series of longitudinally and crosswise interwoven strands of linear material, which form various symetrically shaped channels or grooves, this cellular insert also being embedded within a foam formed sock liner, for use internally within an athletic or other shoe for comforting the wearer of the shoe and its incorporated liner as in usage during participation within a variety of sporting events, such as football, basketball, jogging, court playing, or even walking, or other such endeavors.

18 Claims, 3 Drawing Sheets

CUSHIONING AND IMPACT ABSORPTIVE MEANS FOR FOOTWEAR OPERATIVE COMPONENT

CROSS-REFERENCE TO RELATED APPLICATION

The subject matter of this invention and patent application relates to, and comprises a continuation-in-part of, the patent application filed by Raymond F. Tonkel and Alexander L. Gross, under Ser. No. 705,659, on Feb. 26, 1985, now U.S. Pat. No. 4,656,760, and both said patent and this application being owned by a common assignee.

BACKGROUND OF THE INVENTION

This invention relates generally to fabrication of footwear, and more specifically components used in conjunction with athletic shoes, and particularly pertains to the application of cellular insert means within the structure of the shoe, shoe insole, or sock liner for use in conjunction therewith, and which effectively resists the transmission of forces of impact encountered by the foot and its wearer during application, while simultaneously due to its inherent resiliency and recoil tending to conserve the energy of particularly the athlete while participating in strenuously performed athletic endeavors.

In participation within sporting events, such as court events like tennis and basketball, or in sports such as football, track, or while partaking in the various running events, such as jogging, or even when undertaking exercises through walking, as when the footwear may be used for daily or casual usage, frequently the shoe wearers will encounter the strain and ordeal of sustained pressure and continuing impacting forces, particularly during participation in one of the identified type of athletic events. Such exposure does have a tendency to cause injury and damage to the participant's lower extremities. Anyone who has been active in the sport of basketball, as an example, can readily understand the stress endured and pain suffered from what has been identified as stone bruises, muscle straining, tendon or Achilles stretching, which apparently comprise a bruising to these particular and various components, or the flesh surrounding thereof, or to the heel bone, and which normally occurs from repeated jumping or undertaking of particular types of exercises by the participant during performance of an athletic or related event. In addition, there are a variety of other types of muscle stressing and bruising which causes impairment to the athlete's body, or even to those that do an abundance of walking, or perhaps even from sustained or lengthy standing, which ordinarily occurs because of the direction of impact forces encountered when the footwear worn by such people abruptly contact the ground, as during shoe usage. As a result, there have been directed a significant amount of thought to modifications to shoe structures, particularly integrally of the built-in shoe components, such as the sole, in an effort to combat the type of damage that is sustained by the foot generally during participation and activity undertaken through athletic shoe usage. Such modifications to sports shoes can be seen in the U.S. Pat. No. to Bente, 4,430,810, which incorporates flexible material inserted within the heel wedge in order to dampen vibrations and shock occurring during running, especially upon a hard track. Another patent to Ruskin, U.S. Pat. No. 3,785,646, shows other means for alleviating stress problems particularly when exercising. Another concept for reducing the forces encountered by the athlete during usage of the sport shoe, and which is similar to that previously explained, is the provision of a series of arch-like members arranged within at least the heel portion of a shoe, as disclosed in the U.S. Pat. No. to Inohara, 4,236,326. Other methods have been employed to cushion the foot against impacting forces, such as shown in the U.S. Pat. No. 4,283,864, and also in U.S. Pat. No. 4,364,189.

There are a large variety of other designs that have been built into footwear, and more specifically athletic shoes, as shown in the identified U.S. Pat. Nos. to Giese, 4,316,332, and 4,316,335, in addition to 4,073,072. Another patent to Giese, Pat. No. 4,005,532, shows a form of insulated insole construction. The addition of stabilizer means to the rear sole portion of an athletic shoe is also shown in the Turner patent, No. 4,364,188. Other related patents include the U.S. Pat. Nos. 4,380,878, 3,918,181, 4,325,194, 4,322,892, 4,322,891, 4,063,371, 4,078,321, 4,391,048, 4,267,648, 4,398,357, 4,262,433, 4,187,620, 4,222,185, 2,721,400, 2,437,227, 4,272,899, 4,179,826, 4,342,158, 4,102,061, 4,118,878, 3,568,340, 3,808,713, 3,608,215, 4,223,456, 4,235,026, 4,271,606, 4,012,854, 508,034, 1,069,001, 1,506,975, 1,942,883, 2,627,676, 3,871,117, and 3,785,069. Thus, as the foregoing indicates, there are a voluminous number of shoes and sole structures designed principally for the provision of adding cushioning to the shoe, and to protect the foot, as during footwear application. On the other hand, as can be seen and determined from the herein described invention, the concept of incorporating a cellular insert, generally formed of a woven or wound polymeric material, wherein the woven or helical wound cellular components are embedded within particular locations of the insole means, or the sock liner associated with the footwear, and generally have its internal cavities filled with the either the same or a textured polyurethane, or other polymer foam, that forms these identified components has apparently just never been revealed in the prior art.

Hence, it is the principal object of this invention to add a cellular insert into the construction of an insole means, or sock liner, which in this particular instance is generally formed of polymer foam, generally for use in conjunction with the athletic shoe, for the purpose of conserving the energy of the shoe user, and resisting and dampening the transmission of the forces of impact from the ground, through the shoe sole, and to the foot of its wearer.

Another significant object of this invention is to furnish the athlete with means for readily attaining energy efficiency and conservation by embedding within a readily replacable insole means, or a sock liner, the insert of this invention for providing sustained rebound capacity which results in greater energy return with each foot stride, therefore reducing foot fatigue, as well as actually reducing the energy necessary to run and actively partake in an athletic event.

A further object of this invention is to provide a cellular coil system that is embedded at particular locations within the shoe sole, its sock liner, which normally rests upon the shoe sole, or its insole, and which is predetermined and designed for resisting specific directional forces of impact encountered by the shoe during usage by the athlete or other person.

Another object of this invention is to design into the construction of the insole means of an athletic or other shoe, or the insole means used in conjunction therewith, preferably a woven polymer cellular insert that adds multi-dimensioned densities to the shoe components, and which effectively resists the forces of impact while the athlete participates in rather strenuous athletic endeavors.

A further object of this invention is to provide a readily insertable, or removable, insole means, or sock liner, having embedded therein the cellular inserts of this invention, and which may be used in conjunction with a walking shoe, jogging shoe, or the like.

More specifically, another object of this invention is to provide for the integral incorporation of a cellular woven or strand woven fabric of material into precise locations of a shoe insole, or a sock liner, for various styles of shoes, and particularly athletic shoes, in order to resist the forces of impact that may be encountered by such select shoes and their wearer during application and within specific athletic endeavors, such as the identified athletic shoe that may be used during basketball, to resist the directly downward forces of impact, or perhaps in running shoes, wherein the main thrust of force is in the constant pressures encountered during foot pronation, while participating in such an activity, or perhaps which may also be used within the general walking shoe, all in order to facilitate and enhance the protective results attained during usage.

Another object of this invention is to provide a sock liner for use in conjunction with footwear and which exhibits unsurpassed comfort.

Another object of this invention is to provide an insole means, fabricated as a sock liner, which provides improved protection against damage sustained through shock inducing forces encountered by the foot during footwear application.

Yet another object of this invention is to provide a coiled type of energy built into a shoe component, in order to aid in reduction of foot fatigue.

Another object of this invention is to provide a very efficient and effective walking shoe through application of the structure of this invention.

These and other objects will become more apparent to those skilled in the art upon reviewing the summary of this invention, and upon undertaking a study of the description of its preferred embodiment, in view of the drawings.

SUMMARY OF THE INVENTION

This invention envisions the locating integrally within particular portions of shoe components, such as the sock liner, or the insole for the shoe, or even the shoe sole itself, flexure style of woven strands or wound material, such as of polymer, nylon, or the like, and which are designed to have a higher Durometer or Shore hardness than that of the surrounding foam, such as a urethane foam, from which the basic sole, insole means or sock liner is fabricated. The purpose of this type of an addition is to effectively produce resistance against the forces of impact encountered by the foot particularly of the athlete during participation within rather vigorous sporting events, or to aid against the fatigue associated with sustained efforts undertaken during jogging or through extended walking. Such woven material may be of the resilient type, being flexible in texture, having recoil attributes, but yet having sufficient hardness to return to its initial structural shape after deformation during its application specially within the sock liner, or insole, during shoe usage. Also, such material is designed and intended to resist the pressures exerted upon it. By way of example, it is well known that the athlete, such as the basketball player, when descending from a jump, may sustain impacting forces that are many times greater, such as three to four times of his/her own weight, so that when such an athlete, of a significant weight class, hits the floor upon a descent, the forces of impact upon the shoe sole may be substantially absorbed by a located insole, or the sock liner applied within the shoe by the athlete before partaking in such an event. Similiar type of attributes can be attained by the walker, when utilizing supplemental shoe components as defined for this invention.

This invention generally envisions the formation of a woven like fabric of material, having a series of cellular components, generally exhibiting a sine wave characteristic, formed intermediate a pair of fabric liners, the cavities formed within the interior of the components being either void, or preferably filled with the same or a different type foam, such as polyurethane foam, or other like material from which the shoe insole or sock liner is basically constructed. In any event, the Durometer hardness of this cellular insert is greater, by as much as two to eight or more times, than the hardness of the foam in which it is implanted, and thus, due to the circular or spiral pattern formed of the cellular component, and which may also be helical wound in its construction, the forces of impact are absorbed by these plurality of structures, as maintained in adjacency, interwoven with each other, but yet fixed in position between their upper and lower fabric layers, in order to effectively resist the transmission of forces from the ground, through the shoe, and to the athlete's foot. As is well known, shoe soles formed alone from polyurethane liquid foam system just exhibit poor shock absorbing or resisting characteristics.

In addition to the foregoing, alternative embodiments for the woven like fabric of material of this invention includes its construction from a series of strands of interwoven polymer material, which may be lineally or sinusoidally woven, or to other conic section shapes, and which in effect form a series of alternate vertices, or apices, with grooves or valleys being located intermediately thereof, with this type of a construction providing a very effective resistance against the forces of vertical impact that are encountered by the shoe, and the foot of the wearer, particularly when partaking in strenuous exercises encountered in the type of athletic endeavors as previously explained. In effect, the lined woven strands of material of this invention generally exhibit a rather rectangular or squared appearance, formed at the corners which have central depressions located therein, alternating throughout the entire spread of fabric as along its length and width, so as to form a type of plurality of cellular like components, arranged in adjacency with each other, and which tend to resist the forces of impact encountered particularly when directed vertically upwardly against the bottom of the athletic shoe. In addition, because the woven strands of material are fabricated of rather resilient like polymer, the material, when fabricated, does exhibit an inherent ability to recoil, through its integral resiliency, which has a tendency to aid, as for example, the walker or the jogger, when undertaking foot pronation, through the usual curvature of the walking pattern, when performing the usual foot manipulations encountered during functioning in this type of activity.

The cellular inserts of this invention, and forming the type of herein identified shoe components, may be arranged at particular locations within the defined shoe parts, such as the insole, or the sock liner, and it is even further envisioned that the woven strand type of material might even be embedded within the sole of the footwear itself, as previously alluded to, throughout its extent, or at those strategic locations where it has been predesigned and determined that the forces of impact, and bending of the foot, most frequently incur and are encountered by the athlete or user when undertaking the type of activity as previously explained. For example, in the standard athletic shoe, the coil or component system of this cellular insert may be arranged substantially centrally and along the length of the formed insole, or its sock liner, on the other hand, where a jogging shoe is involved, perhaps even dual or more layers of the cellular insert may be located integrally within the heel-sole structure for the insole, in order to be more effective in resisting direct forces encountered by the runner, as the heel repeatedly impacts directly upon the ground during sequential running motions. Alternatively, in the basketball style of shoe, the system designed as most effective is the arrangement of the cellular coil means of this invention along the upper surface of the shoe sole, as explained in our previous application, and therefore, providing this type of material within the insole portion of the shoe, or within a sock liner, readily locates and positions the material at its most effective location for providing resistance against the type of forces encountered during participation within this type of an athletic event.

In addition, the cellular inserts may be located transversely of these shoe components, longitudinally of the same, or in a variety of other angular directions, as may be believed to provide the most effective resistance against force transmission through the sole of the athletic shoe.

Furthermore, the cellular inserts may be located within a separately formed midsole portion for the insole or sock liner, and then encapsulated within the overall component structure, as when it is shaped into its finished form. Furthermore, the woven structure for the cellular insert may include, or be separately formed, as spirally wound strands of polymer, or related materials, or interwoven strands of polymer material, as previously explained, having the Durometer or Shore hardness generally exceeding that of the foam material in which it locates, in order to resist against force transmission. Also, these wound cellular components may be particularly shaped, such as having flattened upper and lower surfaces, or be perpendicularly arranged, in order to resist directly against the line and direction of force transmission, such as along the upper and lower surfaces of the shoe insole and sock liner components. Or, these components may be located at the heel portion of the jogging or running style of shoe, or within its formed insole, or sock liner, and the shaped woven fabric may have flattened or related surfaces designed for exposure substantially perpendicularly to the direction of transmission of the type of impact forces that have been determined to be encountered, under such conditions, in order to better absorb such pressures, and to resist against their transmission to the foot.

DESCRIPTION OF THE PREFERRED EMBODIMENT

Figure 1:
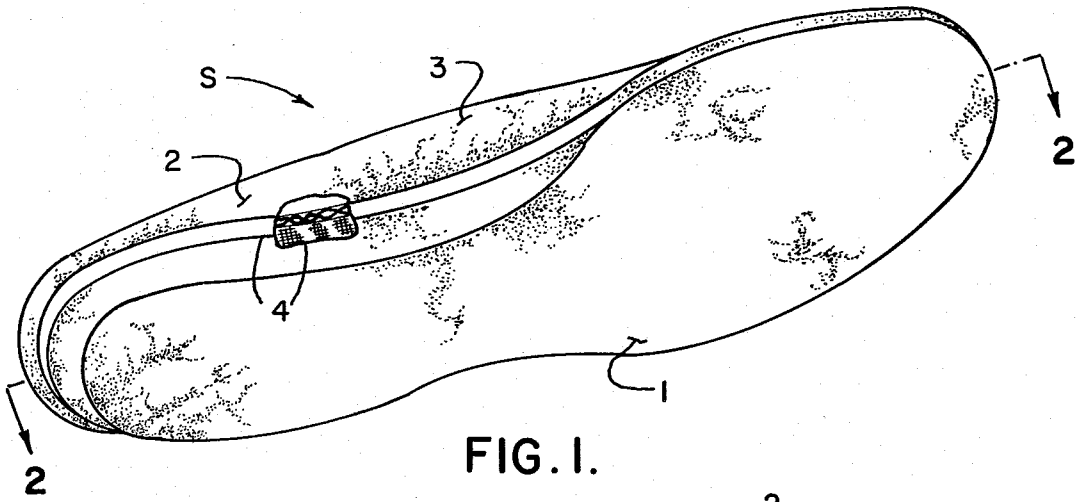
FIG. 1 is an underside perspective of a sock liner or shoe sole showing the location of the cellular insert of this invention of the type, that may be used in conjunction with the athletic, walking, or casual shoe.
Figure 2:
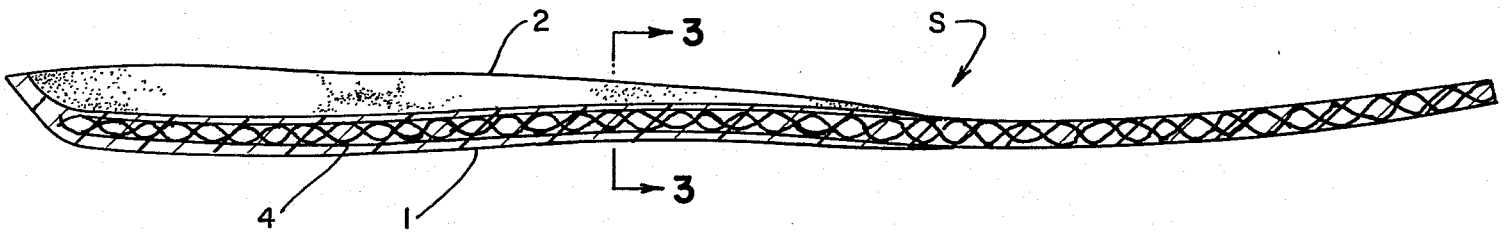
FIG. 2 is a longitudinal sectional view taken along the line 2—2 of FIG. 1.

In referring to the drawings, and in particular FIGS. 1 and 2, the basic configuration of a sock liner, and which may also be fabricated into the shape of an innersole, or into the shoe sole, as shown at S, is readily disclosed, and which comprises the usual length of such a liner, having a base portion 1 with upwardly curved lateral segments 2, which normally are provided for embracing the side edges of the footwear in which the sock liner locates, and at the same time, provides integrally an arch supporting portion, as at 3, for providing support for this aspect of the foot that may fit within the footwear or athletic shoe in which this liner locates. Generally, the sock liner of this invention will be molded of a type of foamed material, such as a polymer, fabricated as a polyurethane or other foamed or solid polymer, and which will have integrally located therein the cellular insert 4 of this invention. While the insert 4 is shown as extending to the side edges of the formed sock liner S, obviously, as previously explained, the insert means may extend only partially transversely across the footwear, extend part or fully along the length of the formed liner, and not necessarily be exposed at its side edges, as can be seen. It is this strategic locating of this type of a cellular insert within the sock liner, or fabricated innersole, or within the shoe sole itself, that is the subject matter of this invention, in order to resist the particular types of impacting forces that may be encountered by the footwear user, depending upon the type of activity in which he/she participates. This has already previously been reviewed.

Figure 4:
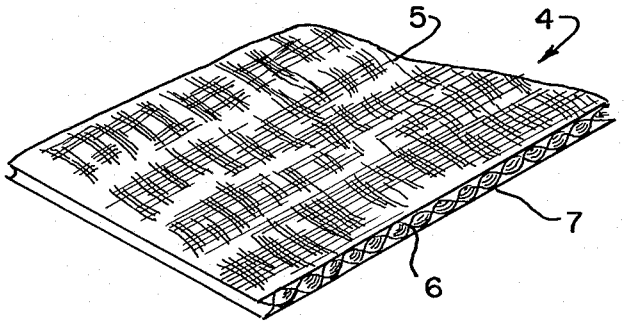
FIG. 4 is an isometric view of one type of polymer insert, as shown in the previous figures, as integrally embedded within the formed sock liner or insole means for use in conjunction with an athletic or other shoe.
Figure 3:
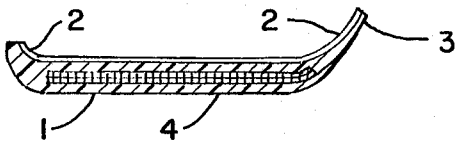
FIG. 3 is a transverse sectional view taken along the line 3—3 of FIG. 2.
Figure 5:
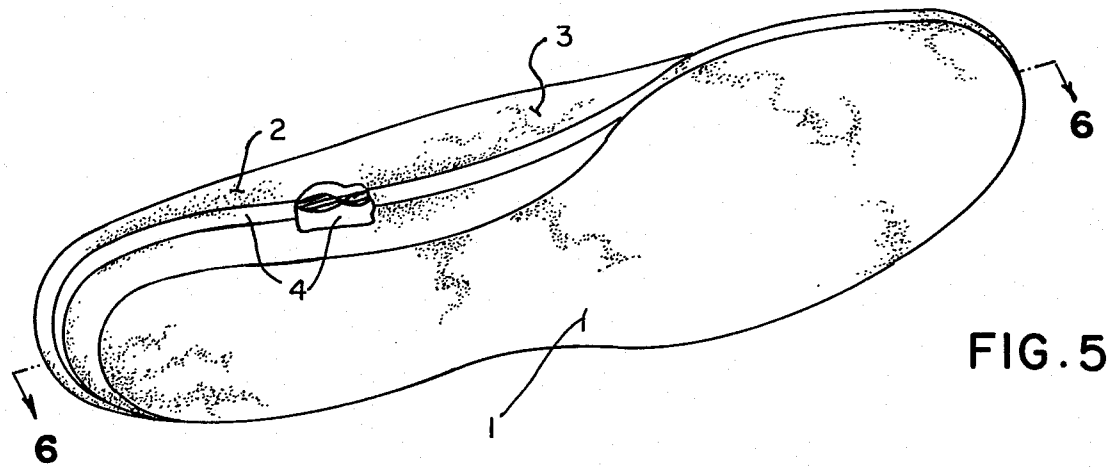
FIG. 5 is a lower perspective view of another form of insole means or sock liner and incorporating a modification to the polymer insert means inserted within the sock liner or insole means of this particular invention.
Figure 6:
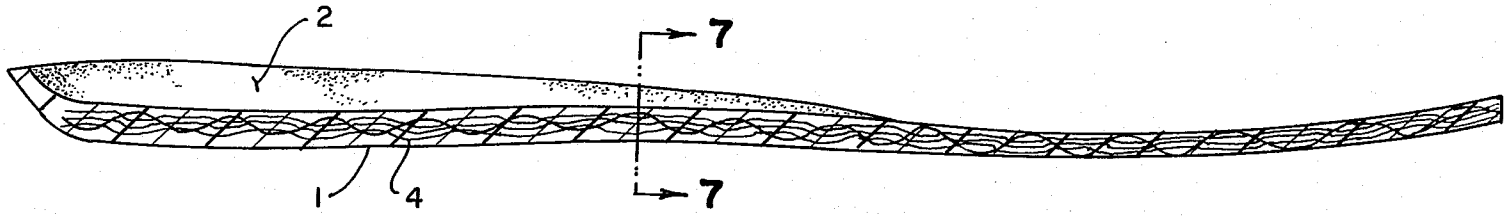
FIG. 6 is a longitudinal sectional view of the combined polymer insert means and sock liner taken along the line 6—6 of FIG. 5.
Figure 7:
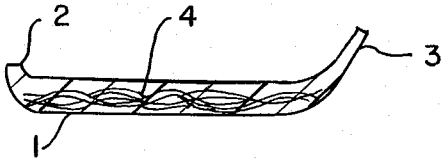
FIG. 7 is a transverse sectional view taken along the line 7—7 of FIG. 6.

The cellular insert of this invention is generally formed of a woven material, usually a polymer, such as nylon, polypropylene, polyethylene, or other monofilament or copolymer structures, as can be seen in FIGS. 2 through 4. It normally comprises and is fabricated having an upper layer of material 5 generally woven from the same type of strand of polymer used for fabricating its cellular components 6, and then also incorporates a lower woven liner 7, having said series of cellular components 6 arranged intermediately thereof. The intermediate layer is preferably formed of a pair of inverted, with respect to each other, sine wave configured intermeshing layers of woven material, that form together the sinusoidal cellular like components for forming the insert of this invention. This can clearly be seen in FIG. 4. In this configuration, any pressure exerted upon the liners is exerted through to the components 6, which when they attempt to flatten or spread apart, force against each other and function as a buffer to resist the impacting force, and function as a pressure absorber. Obviously, since these interwoven sine wave configured intermediate cellular components 6 are also woven integrally into the fabrication of the upper and lower liners 5 and 7, the upper and lower liners have a tendency to fix the cellular components in place, and when they attempt to spread apart, or pressure against each other, the upper and lower liners resist such dissemination of their configured cellular shape, function to fix the cellular components into position, and to function as a shock absorber, or to add to the resiliency for recoiling of the insert, and the sock liner or inner sole in which it locates, back to its initial standard horizontally shaped configuration. Thus, the cellular insert, as previously explained, as fabricated into a sock liner, or other component, has a tendency to also function as a means for aiding in the resiliency of the shoe sole, upon which the liner locates, thereby having a tendency to conserve the energy of the athlete, or user of the footwear, by incorporating this inherent resiliency, within the shoe structure itself, rather than requiring the foot of the participant to force the shoe into its customary shape, as when not in use.

The particular fabricated cellular insert of this invention may be located in place within the mold employed for forming of the sock liner, when initially fabricated, so that when the liner is molded in place, and fabricated, from generally a polyurethane or other foam, or other polymer material, the cellular insert will be located in place generally embedded integrally within the formed sole. But, it may be desired at particular locations that the cellular material may be exposed to the surface of the sock liner, particularly at its upper surface in that segment of the arch supporting area, as at 3, as previously explained. At this location, the cellular insert can provide a direct support for the arch portion of the foot, since it does have a greater Durometer hardness than the polymer foam forming the sock liner itself, and in addition provide some aeration or ventilation for the foot at that location. The polymer-like material, when foamed in place, is molded around the cellular insert and may be located within the cellular cavities, or such cavities may remain free of any foamed material, during molding, such as shown, respectively, in FIGS. 9 and 10 of the parent patent to this application, U.S. Pat. No. 4,656,760, and which figures of the drawings, and pertinent descriptive portions within its specification, are incorporated herein by reference.

As also previously described, the polymer material forming the cellular insert of this invention may be formed of a variety of materials, generally of polymer construction, such as the polypropylene or polyethylene, as previously explained, and will have a Durometer or Shore C hardness in the range in excess of that preferred hardness for the fabrication of the sock liner or innersole material itself. In addition, as also previously explained, the liquid formed foam material normally fabricating the sock liner of this type is in the range of a Shore hardness of between about 20 to 60, with a density o about 0.08 to 0.05, or substantially less, as normally fabricated into a sock liner of this design. Hence, as previously explained, the hardness of the material forming the cellular insert of this invention is of a hardness generally exceeding that of the foamed innersole, and therefore, due to its particular configuration, functions as a resistor to dampen against the transmission of any forces of impact through the shoe sole, or through the sock liner, to prevent it from encountering directly upon the foot of the athlete wearing any designed shoe in which the liner of this invention locates., In addition, and as previously explained, while in the preferred embodiment the intermediate segment 6 of the cellular insert may be formed of a pair of inverted sine wave shaped members, interwoven together, it is just as likely that these cellular components may comprise spirally wound or helically shaped coils of such material, which may be fastened together at their side edges, and then embraced between and affixed to the upper and lower liners 5 and 7 of the shown insert. This will work just as effectively as the interwoven cellular component as previously explained. This particular type structure is readily disclosed in FIGS. 16 through 19 of the parent U.S. Pat. No. 4,656,760, and which drawings, and pertinent descriptive information within its specification, are incorporated herein by reference.

Figure 8:
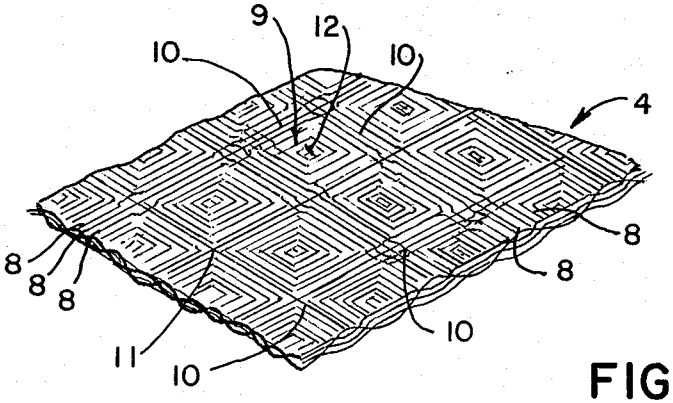
FIG. 8 is an isometric view of the woven strand type of polymer insert means used in conjunction with the formation of the shoe sole, or the sock liner or insole means of this particular invention.

A modification to the structure of this invention is also shown in FIGS. 5 through 8. In this particular instance, the same type of sock liner is yet formed, having the bottom layer 1 with an upwardly turned lateral side edges 2 having the arch supporting portion 3 integrally formed therein, and incorporating the molding of the cellular insert 4 into the structure of this invention. In this particular instance, the cellular insert is formed in a somewhat different manner, but is designed to function in very related way as that of the cellular insert as particularly defined previously herein. In this instance, the cellular insert includes a series of woven strands of linear material, as at 8, and as shown in FIG. 8, which when woven into their configured position form a type of inverted pyramidical depressions, as at 9, intermediate a series of arranged side disposed vertexes, as at 10, and in this manner form a type of cellular composition, which has a tendency to resist compression, particularly the impacting forces are exerted substantially vertically against the sock liner, and any athletic footwear in which the liner locates. In addition, the interweaving of the strands 8 together also has a tendency to fix the cellular insert in its horizontal or normal configuration, so that any bending of the same exhibits integral resiliency which snaps the insert back to its horizontal configuration, within the formed sock liner or innersole, to assure and aid in the recoil of the footwear back to its normal disposition. Generally, for the shaped cellular insert as shown in FIG. 8, wherein it forms a series of centralized depressions or grooves, as at 9, which are rather like an inverted pyramid, a similar type of shape for the cellular insert is formed upon its underside, under each location where a pair of ridges 10 cross, as under the location 11, where depicted. Thus, the strands forming the ridges 10 upon the upper surface of the cellular insert have corresponding ridges, running both lengthwise and transversely of the formed insert, at the location of their underside of the formed insert, such that the location of each inverted pyramid 9 on the top side, as at that lowest depression, formed at 12, has a corresponding ridge formed on the underside. Thus, the formed cellular insert, as disclosed, provides a series of upright and inverted pyramid or truncated shaped valleys, on both the upper and lower surfaces of the formed insert 4, which is woven into this configuration before it is inserted into the mold, and then has the polymer foamed around it, when forming the sock liner or innersole structure of this invention. Thus cushioning is created from this type of structure. The Durometer and Shore C hardnesses of the various strands forming the cellular insert 4 of the structure disclosed in FIG. 8 will be similar to and related to that which has already been defined, and likewise, the foamed polymer forming the structure of the sock liner itself, will also have equivalent ranges of hardness of the type as previously explained. The same holds true in the usage of these inserts when embedded within a shoe sole.

And, once again, the structured cellular insert may locate entirely along the length of the liner, and also extend for its full width, or may be located at isolated locations within the formed liner, in order to resist the type of impacting forces that may be encountered at strategic points along the length of the footwear, when in usage. The decision as to where to specifically locate the inserts can be determined for each design contemplated, and the type of forces to be encountered. In addition, the cellular insert may also be exposed at various locations, generally along the upper surface of the formed sock liner S, such as, as previously explained, at the vicinity of the arch support. But, in the preferred embodiment, generally the cellular inserts 4 of this invention will be totally embedded within the foamed polymer forming the structure of the sock liner, and which fills all of the voids, such as the cylindrical cavities extending through the intermediate cellular component 6 of the insert shown in FIG. 4, or fill the various grooves 9, both along the upper and lower surfaces of the cellular insert as shown in FIG. 8.

Figure 9:
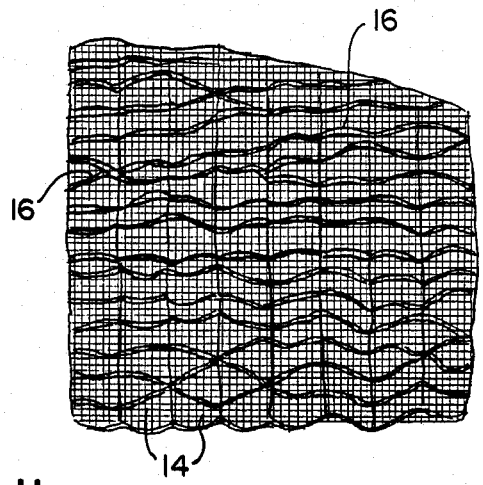
FIG. 9 is a top plan view of another modification to the woven strand type of polymer insert means used in conjunction with this invention.
Figure 11:
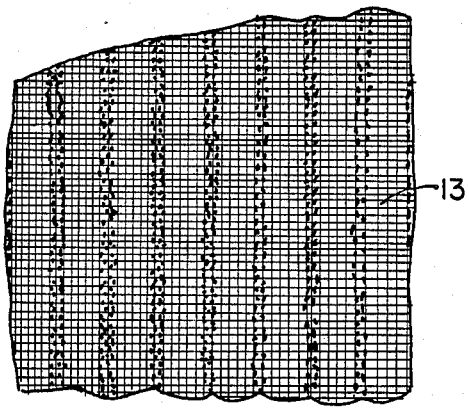
FIG. 11 is a bottom view of the insert means taken along the line 11—11 of FIG. 10.
Figure 10:
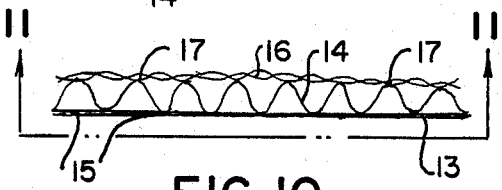
FIG. 10 is an edge view of the insert means shown in FIG. 9.

Various other modifications to the style of cellular inserts contemplated for this invention are also shown in FIGS. 9 through 11. As therein disclosed, and particularly as can be seen in FIG. 10, a base liner 13 has a sinusoidally shaped woven portion of fabric, as at 14, arranged thereon. The lower tips or extremities 15 of the cellular portion 14 of the insert are generally woven, fixed, or otherwise held to the lower liner 13. In addition, a series of generally parallel arranged strands, as at 16, provide a form of upper layer or liner for the insert, and interconnect with the upper apexes, as at 17, for linking these upper segments of the sinusoidally intermediate insert 14 together. Thus, as can be seen, when the insert of this invention is located within the sock liner, the inner sole, or even within a shoe sole, and foamed in place, any pressure exerted upon these components, and particular upon the insert, has a tendency to cause its flattening, which is resisted by means of the interconnection of the intermediate portion 14 with both its lower liner 13, in addition to being stranded together by means of the upper formed layer 16. Thus, the tendency of the insert to flatten, is substantially resisted, which has a tendency to absorb the perpendicular forces exerted upon the insert, during its application, and likewise, the interlinking of the various upper and lower liners or strands to the intermediate cellular insert 14 has a tendency to fix its disposition along a horizontal plane, such as shown in FIG. 10, and therefore also has a tendency to resist bending forces that may be exerted upon the same.

Figure 12:
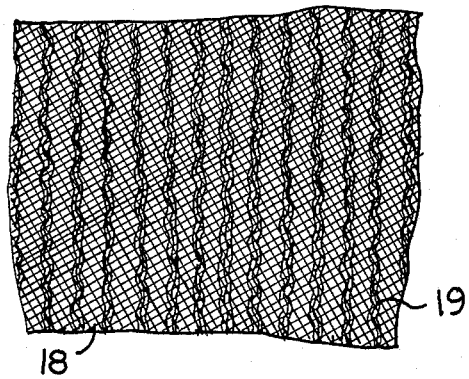
FIG. 12 is a plan view of another style of woven strand polymer insert means used in conjunction with this invention.
Figure 13:
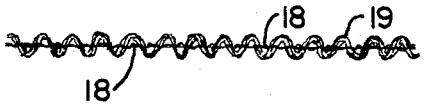
FIG. 13 is a lower edge view of the insert means shown in FIG. 12.

A related type of modification to the cellular insert of this invention is shown in FIGS. 12 and 13. In this particular embodiment, the insert includes a centrally disposed liner 18 which is arranged or generally affixed, or perhaps woven, at the midpoint of the undulating appearance or the sine wave configuration for the cellular component 19. This particular embodiment, as can be determined, has a tendency to significantly resist vertical or perpendicular forces exerted upon the insert, since the central strand 18 has a tendency to fix the various sinusoidally shaped members in position with respect to each other, and therefore, prevents their spreading apart, as when a crushing force is exerted upon it. In addition, since the insert, as like all of the previously described inserts, are formed of a type of polymer material, or a nylon, they have a tendency to have memory with respect to their initial configuration, and therefore, incorporate inherent resiliency to snap back to their molded configuration, to thereby resist bending forces that may be exerted upon the shoe, or the sock liner, in which this insert locates.

Variations or modifications to the structure of this invention may occur to those skilled in the art upon reviewing the subject matter of this invention. Such variations, if within the spirit of this invention, are intended to be encompassed within the scope of any claims to patent protection issuing upon this invention. The specific structure for this invention, as defined herein, and its modifications, as explained, are set forth principally for illustrative purposes only.

Having thus described the invention, what is claimed and desired to be secured by Letters Patent is:

1. A cushioning and impact absorptive means for application within footwear of the type having a shoe upper affixed to a sole formed at least partially of a polymer-like material, comprising, a shoe upper, and a shoe sole, said upper secured to said sole, means operatively associated with the shoe sole to provide cushioning for the said footwear during its application, said means also being formed of a polymer-like material, a cellular insert, said cellular insert being applied within the polymer-like material formed associated with the said shoe sole, said cellular insert comprising upper and lower layers of woven polymer material, and also comprising a series of sinusoidally shaped cellular components formed of woven polymer-like material and arranged intermediate and connecting to said layers of said polymer material, said cellular components formed having upper, lower, and side surfaces, said layers of polymer material connecting with the upper and lower surfaces of the said cellular components, said cellular components having cavities generally formed therethrough, with said formed cavities being arranged intermediate the said upper and lower layers of the cellular insert, the series of cellular components provided therein being secured together along their contiguous side surfaces, said cellular insert being arranged substantially aligned within the said footwear means during shoe usage, said cellular insert as formed of woven polymer material having a hardness greater than the polymer-like material forming the said shoe sole, whereby the cellular insert formed within the sole tending to effect the absorption of any forces of impact, while furnishing conservation of energy for the user of the footwear during application.

2. The invention of claim 1 and wherein said means operatively associated with the footwear sole comprising an insole means.

3. The invention of claim 2 and wherein said insole means comprising a sock liner.

4. The invention of claim 1 and wherein said cellular insert being embedded within the formed footwear sole.

5. The invention of claim 1 and wherein said woven cellular insert being arranged substantially transversely of the formed shoe sole.

6. The invention of claim 5 and wherein said cellular insert being provided substantially along the length of the entire footwear.

7. The invention of claim 6 and wherein said footwear comprising an athletic shoe.

8. The invention of claim 1 and wherein said cellular insert comprising a singular layer of cellular components.

9. The invention of claim 8 and wherein said cavities of the cellular components being substantially filled with the polymer-like material forming the shoe means.

10. The invention of claim 8 and wherein said cavities of the cellular components being void of any of the polymer-like material forming the sheet means.

11. The invention of claims 1 and wherein said cellular insert applied within the polymer-like material being formed of a series of interwoven strands of woven polymer material, said woven polymer material forming alternate rows of apices with grooves being arranged intermediately thereof, with said cellular insert being enclosed within the polymer-like material forming the shoe means operatively associated with its sole intending to effect absorption of any forces and to achieve conservation of energy during application of the footwear during usage.

12. The invention of claim 11 and wherein said woven coils being arranged substantially transversely of the formed shoe means.

13. The invention of claim 12 and wherein said shoe comprising an athletic shoe.

14. The invention of claim 13 and wherein the hardness of the woven cellular components being greater than the hardness of the polymer-like material forming the shoe means.

15. The invention of claim 14 and wherein said apices and grooves being substantially filed with the polymer-like material forming the shoe means.

16. The invention of claim 15 and wherein said cellular insert extending over the length of the footwear.

17. The invention of claim 1 and wherein said upper layer of the woven polymer material comprising strands of material, and which is woven to the upper apexes of the cellular components arranged therein.

18. A cushioning and impact absorptive means for application within a footwear of the type having a shoe upper affixed to a sole formed at least partially of a polymer-like material, comprising a shoe upper, and a shoe sole, said upper secured to said sole, means operatively associated with the shoe sole to provide cushioning for the said footwear during its application, said means also being formed of a polymer-like material, said means comprising a cellular insert applied within the said polymer-like material operatively associated with the sole, said cellular insert comprising at least one layer of woven polymer material and a sinusoidally shaped cellular member arranged intermediate and connecting with said layer to form said means operatively associated with the sole, said layer of woven polymer material comprising an intermediate layer of woven material and being arranged woven approximately through the midpoint of the sinusoidally shaped cellular insert, whereby the cellular insert formed within the sole operative means tending to effect absorption of any forces of impact encountered by the footwear during usage, while adding resiliency and recoil for achieving energy conservation during its shoe application.

* * * * *

UNITED STATES PATENT AND TRADEMARK OFFICE

CERTIFICATE OF CORRECTION

PATENT NO. : 4,805,319

DATED : February 21, 1989

INVENTOR(S) : Raymond F. Tonkel

It is certified that error appears in the above—identified patent and that said Letters Patent is hereby corrected as shown below:

Claim 10, column 11, line 34, change "sheet" to ---shoe---.

Signed and Sealed this

Nineteenth Day of September, 1989

*Attest:*

DONALD J. QUIGG

*Attesting Officer*

*Commissioner of Patents and Trademarks*